US007402977B2

(12) United States Patent
Kim et al.

(10) Patent No.: US 7,402,977 B2
(45) Date of Patent: Jul. 22, 2008

(54) APPARATUS AND METHOD FOR CONTROLLING OPERATION OF RECIPROCATING MOTOR COMPRESSOR

(75) Inventors: Hyung-Joo Kim, Seoul (KR); Kyung-Bum Heo, Gyeonggi-Do (KR); Chel-Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 412 days.

(21) Appl. No.: 11/180,580

(22) Filed: Jul. 14, 2005

(65) Prior Publication Data

US 2006/0127225 A1 Jun. 15, 2006

(30) Foreign Application Priority Data

Dec. 10, 2004 (KR) ..... 10-2004-0104397

(51) Int. Cl.
*H02P 27/04* (2006.01)

(52) U.S. Cl. ..... 318/798; 318/801; 318/805; 417/44.1; 417/45

(58) Field of Classification Search ..... 318/798, 318/801, 805; 417/44.1, 45, 44.11
See application file for complete search history.

(56) References Cited

U.S. PATENT DOCUMENTS 5,861,697 A * 1/1999 Sugita et al. ..... 310/166
6,208,497 B1 3/2001 Seale et al.
6,537,034 B2 * 3/2003 Park et al. ..... 417/44.1
6,779,982 B2 * 8/2004 Heo
6,815,922 B2 * 11/2004 Yoo et al. ..... 318/632
2001/0043450 A1 11/2001 Seale et al.
2002/0064463 A1 * 5/2002 Park et al. ..... 417/44.1
2003/0129063 A1 7/2003 Jeun
2003/0180151 A1 9/2003 Jeun
2004/0108824 A1 * 6/2004 Ueda et al. ..... 318/114

FOREIGN PATENT DOCUMENTS

CN 1356472 7/2002

* cited by examiner

*Primary Examiner*—Rina I Duda
(74) *Attorney, Agent, or Firm*—Greenblum & Bernstein, P.L.C.

(57) ABSTRACT

An apparatus for controlling an operation of a reciprocating motor compressor includes a current integrator for integrating an alternating current applied to a motor of the compressor during each one cycle thereof; and a controller for differently controlling a firing angle of a triac during the positive phase and the firing angle of the triac during the negative phase of the AC voltage applied to the motor based on the integrated value of the current. A loss in the motor can be reduced by avoiding presence of a DC component in the current applied to the motor of the compressor.

11 Claims, 4 Drawing Sheets

APPARATUS AND METHOD FOR CONTROLLING OPERATION OF RECIPROCATING MOTOR COMPRESSOR

BACKGROUND OF THE INVENTION

1. Field of the Invention

The present invention relates to a reciprocating (linear) motor compressor and, more particularly, to an apparatus and method for controlling an operation of a reciprocating motor compressor.

2. Description of the Prior Art

In general, a reciprocating motor compressor (hereinafter, for simplicity, referred to as "reciprocating motor compressor") which is operated by a linearly reciprocating electric motor without a crank shaft for converting a rotational motion to a linear motion, a reciprocating compressor has less friction loss, and thus, can provide a higher compression efficiency than other compressors.

When the reciprocating motor compressor is used for a refrigerator or an air-conditioner, a compression ratio of the compressor can be varied to control the cooling capacity by varying a stroke voltage applied to the reciprocating motor of the compressor.

The conventional controlling of a reciprocating motor compressor will now be described with reference to FIG. 1.

FIG. 1 is a block diagram showing the construction of an apparatus for controlling an operation of a reciprocating motor compressor in accordance with the prior art.

As shown in FIG. 1, the apparatus for controlling an operation of a reciprocating motor compressor includes a current detector 4 detecting a current applied to the reciprocating motor (not shown) of the compressor 6, a voltage detector 3 detecting a voltage applied to the motor, a stroke calculator 5 calculating a stroke estimation value based on the detected current and voltage values and a certain operational parameter of the motor, a comparator 1 comparing the calculated stroke estimation value with a pre-set stroke reference value, and outputting a difference vale according to the compared result, and a stroke controller 2 controlling an operation (stroke) of the compressor 6 by varying the voltage applied to the motor by controlling a turn-on period of a triac (not shown) connected in series with the motor according to the difference value. Herein, when the stroke controller 2 controls the turn-on period of the triac applying power to the motor, it controls a firing angle ($\alpha$1) of the triac during of a positive (+) phase and a firing angle ($\alpha$2) of the triac during of a negative (−) phase of the current flowing at the triac to be the same, i.e., $\alpha 1=\alpha 2$.

The operation of the apparatus for controlling the operation of the reciprocating motor compressor will now be described with reference to FIG. 1.

First, the current detector 4 detects the current being applied to the motor (not shown) of the compressor 6 and outputs the value of the detected current to the stroke calculator 5. At this time, the voltage detector 3 detects the voltage being applied to the motor and outputs the value of the detected voltage to the stroke calculator 5.

The stroke calculator 5 calculates the stroke estimation value (X) of the compressor based on the detected current and voltage values and the operational parameter of the motor according to equation (1) shown below, and then applies the calculated stroke estimation value (X) to the comparator 1:

$$X = \frac{1}{\alpha}\int (V_M - Ri - L\dot{i})dt \tag{1}$$

wherein 'R' is the motor resistance value, 'L' is the motor inductance value, '$\alpha$' is a motor constant, Vm is the value of the voltage applied to the motor, 'I' is the value of the current applied to the motor, and $\dot{i}$ is the differentiated value (di/dt) of 'i'.

Thereafter, the comparator 1 compares the stroke estimation value and the stroke reference value, and applies a difference value according to the compared result to the stroke controller 2.

The stroke controller 2 controls the stroke of the compressor 6 by varying the voltage being applied to the motor of the compressor 6 based on the difference value. This will be described with reference to FIG. 2 as follows.

FIG. 2 is a flow chart of a method for controlling an operation of the reciprocating motor compressor in accordance with the prior art.

First, when the stroke estimation value is applied to the comparator 1 by the stroke calculator 5 (step S1), the comparator 1 compares the stroke estimation value with the pre-set stroke reference value (step S2) and outputs the difference value according to the compared result to the stroke controller 2.

If the stroke estimation value is smaller than the stroke reference value, the stroke controller 2 increases a voltage applied to the motor in order to control the stroke of the compressor (step S3). If, however, the stroke estimation value is greater than the reference value, the stroke controller 2 reduces the voltage applied to the motor (step S4). In this case, in order to increase or reduce the voltage applied to the motor, the turn-on period of the triac (not shown) electrically connected with the motor is controlled to apply the voltage to the motor.

Meanwhile, when the motor is controlled through the triac, a loss in the motor increases. The reason for this will now be described with reference to FIGS. 3A and 3B.

FIGS. 3A and 3B are waveform diagrams showing waveforms of the voltage and current applied to the motor of the reciprocating motor compressor in accordance with the prior art.

As shown in FIG. 3A, in the apparatus for controlling an operation of the reciprocating motor compressor, when the turn-on period of the triac applying power to the motor is controlled, the firing angle ($\alpha$1) of the triac during the positive (+) half cycle phase of the voltage flowing at the triac and the firing angle ($\alpha$2) of the triac during the negative (−) half cycle phase are controlled to be the same. Consequently, the positive phase and the negative phase of the current applied to the motor become relatively asymmetrical.

With reference to FIG. 3B, the asymmetrical current can be divided into symmetrical AC component current and a DC component current, and the DC component current increases a loss in the motor. Namely, the loss in the motor increases according to equation (2) shown below:

$$\text{Motor}_{loss}=i^2(R_{AC}+R_{DC}) \tag{2}$$

wherein 'i' is the current applied to the motor, '$R_{AC}$' is an iron loss and a copper loss arising due to the AC component current applied to the motor, and '$R_{DC}$' is a copper loss arising due to the DC component current applied to the motor. It is noted that the AC component contributes to both the iron loss and the copper loss, while the DC component contributes only to the copper loss.

As stated above, the conventional apparatus for controlling an operation of the reciprocating motor compressor has the problem that since the DC component current is applied, the loss in the motor increases.

U.S. Pat. No. 6,779,982 issued on Aug. 24, 2004 also discloses a conventional reciprocating motor compressor.

SUMMARY OF THE INVENTION

It is, therefore, an object of the present invention to provide an apparatus and method for controlling an operation of a reciprocating motor compressor which capable of reducing a loss in the motor by eliminating a current of a DC component applied to the motor of the compressor.

To achieve these and other advantages and in accordance with the purpose of the present invention, as embodied and broadly described herein, there is provided an apparatus for controlling an operation of a reciprocating motor compressor including: a current integrator for integrating an alternating current applied to a motor of the compressor during each one cycle thereof; and a controller for differently controlling a firing angle of a triac during a positive (+) phase and a firing angle of the triac during a negative (−) phase of an AC voltage applied to the motor based on the integrated value of the current.

To achieve the above object, there is also provided an apparatus for controlling an operation of a reciprocating motor compressor including: a current detector for detecting an alternating current applied to a motor of the reciprocating motor compressor; a voltage detector for detecting a voltage applied to the motor; a stroke calculator for calculating a stroke estimation value of the reciprocating motor compressor based on the value of the detected current and a value of the detected voltage; a current integrator for integrating the current detected during each one cycle thereof through the current detector; a comparator for comparing the stroke estimation value and a pre-set stroke reference value, and outputting a difference value according to the compared result; and a controller for controlling a turn-on period of a switching device connected in series with the motor according to the difference value, generating a control signal for differently controlling a firing angle of the switching device during a positive phase and a firing angle of the switching device during a negative phase of the AC voltage applied to the motor based on the integrated value of the current, and outputting the generated control signal to the switching device.

To achieve the above object, there is also provided a method for controlling an operation of a reciprocating motor compressor including: integrating an alternating current applied to a motor of the compressor during each one cycle thereof; and differently controlling a firing angle of a switching device during a positive phase and a firing angle of the switching device during a negative phase of an AC voltage applied to the motor based on the integrated current value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
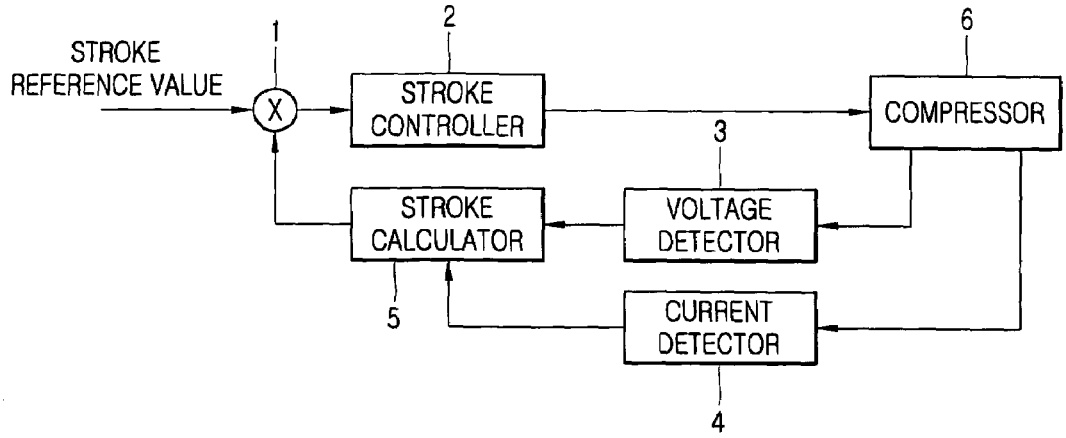
FIG. 1 PRIOR ART
FIG. 1 is a schematic block diagram showing the construction of an apparatus for controlling an operation of a reciprocating motor compressor in accordance with the prior art.
Figure 2:
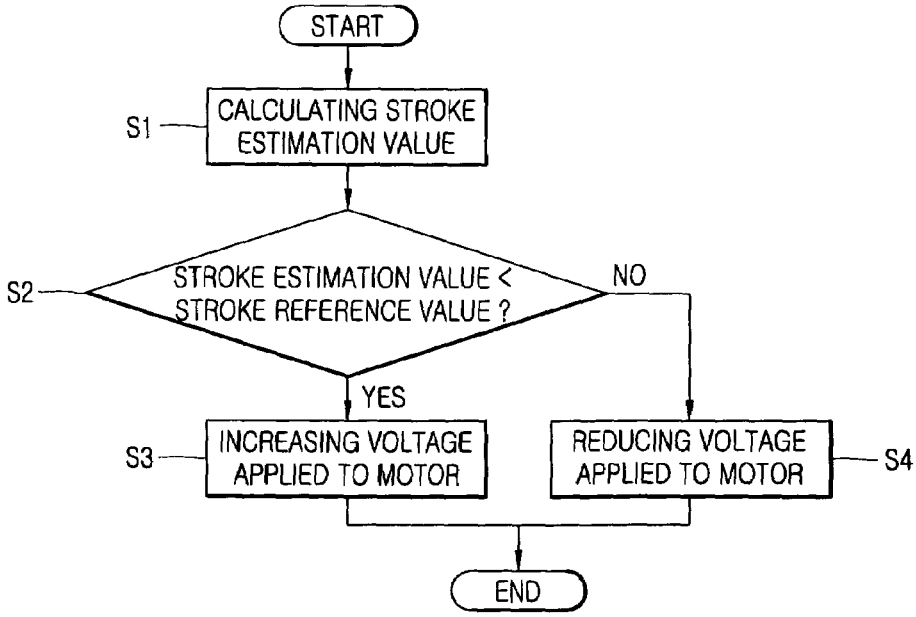
FIG. 2 PRIOR ART
FIG. 2 is a flow chart of a method for controlling the operation of the reciprocating motor compressor in accordance with the prior art.
Figure 3A:
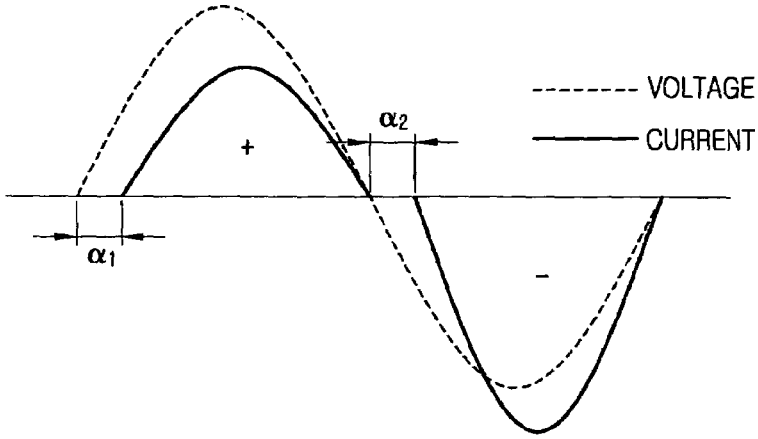
FIG. 3A PRIOR ART
FIGS. 3A and 3B are waveform diagrams showing waveforms of a voltage and a current applied to a motor of the reciprocating motor compressor in accordance with the prior art.
Figure 3B:
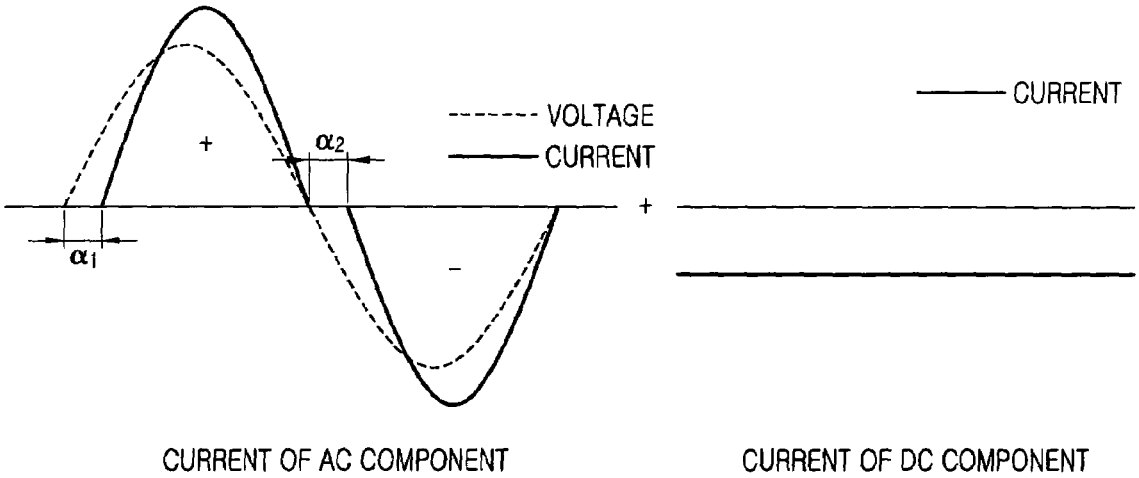
FIG. 3B PRIOR ART
Figure 4:
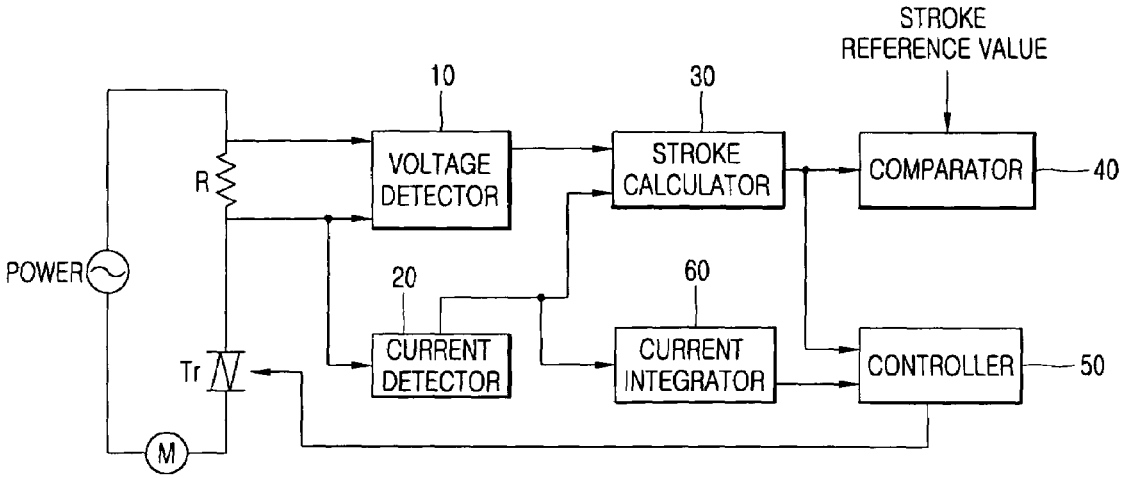
FIG. 4 is a schematic block diagram showing the construction of an apparatus for controlling an operation of a reciprocating motor compressor in accordance with the present invention.
Figure 5:
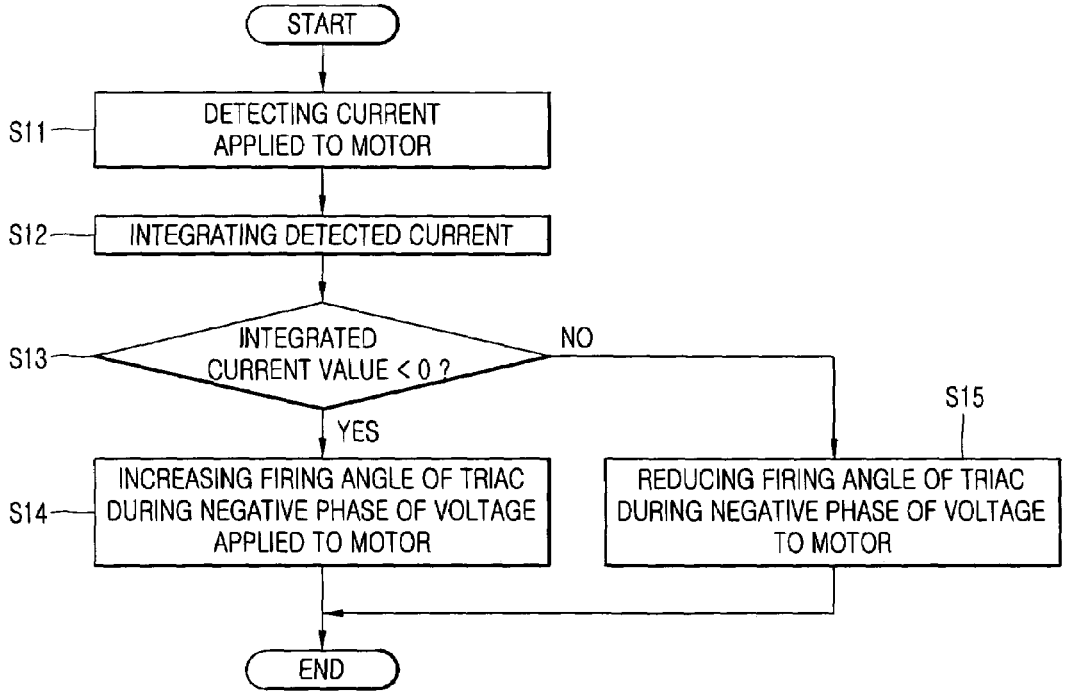
FIG. 5 is a flow chart of a method for controlling the operation of a reciprocating motor compressor in accordance with the present invention.
Figure 6:
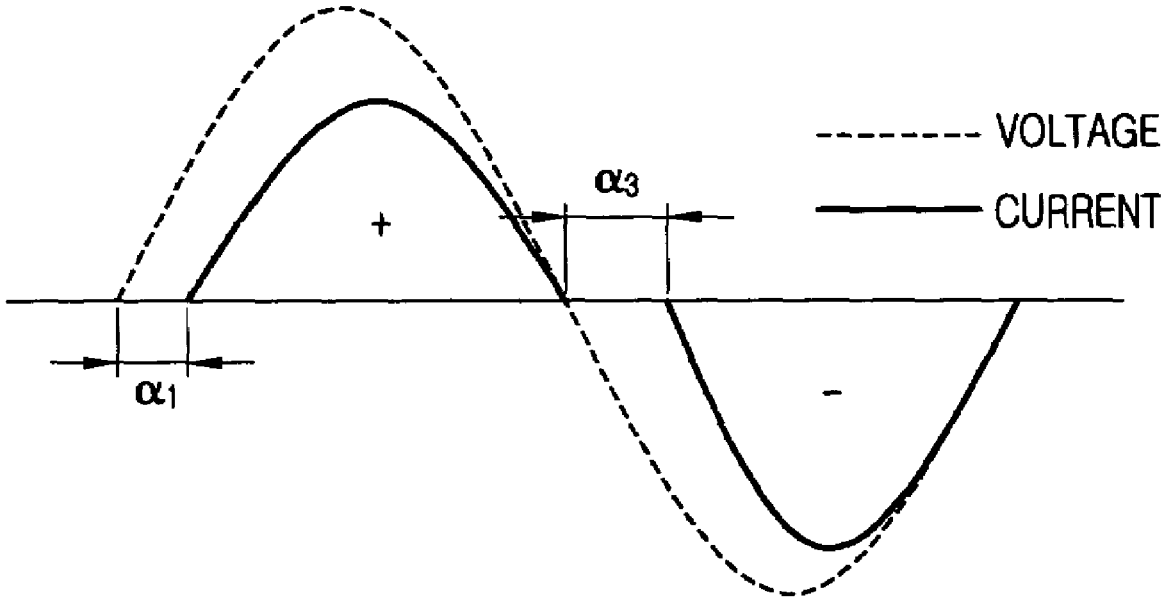
FIG. 6 is a waveform diagram showing waveforms of the voltage and current applied to the motor of the compressor by the apparatus for controlling the operation of the reciprocating motor compressor in accordance with the present invention.

An apparatus and method for controlling an operation of a reciprocating motor compressor in accordance with the present invention which is capable of reducing a motor loss by eliminating a DC component of a current applied to the motor by integrating the current applied to the motor during one cycle and differently controlling a firing angle of a triac during a positive phase and a firing angle of the triac during a negative phase of the current applied to the motor based on the integrated current value will now be described with reference to FIGS. 4 to 6.

FIG. 4 is a schematic block diagram showing the construction of the apparatus for controlling the operation of a reciprocating motor compressor in accordance with the present invention.

As shown in FIG. 4, the apparatus for controlling the operation of the reciprocating motor compressor includes a voltage detector 10 detecting a voltage applied to a motor (M) of the compressor, a current detector 20 detecting a current applied to the motor (M) of the compressor, a stroke calculator 30 calculating a stroke estimation value of the compressor based on the detected current and voltage values, a current integrator 60 integrating the current detected through the current detector 20 during one cycle, a comparator 40 comparing the stroke estimation value and a pre-set stroke reference value and outputting a difference value according to the compared result, and a controller 50 controlling a turn-on period of a triac Tr connected in series with the motor according to the difference value, by generating a control signal differently controlling a firing angle of the triac Tr during the positive phase and during the negative phase of the voltage applied to the motor based on the integrated current value, and outputting the generated control signal to the triac. Herein, the triac is turned on by the control signal and can be replaced with any other suitable switching device such as an inverter.

The controller 50 controls the firing angle of the triac Tr during the positive phase of the voltage applied to the motor according to the difference value likewise as in the prior art. But, if the integrated current value is greater than '0', the controller 50 reduces the firing angle of the triac Tr during the negative phase of the voltage, while if the integrated current value is smaller than '0', the controller 50 increases the firing angle of the triac Tr during the negative phase of the voltage.

When the positive phase and the negative phase of the current applied to the motor during one cycle are asymmetrical, the integrated value of the current applied to the motor during one cycle is smaller or greater than '0'. When the positive phase and the negative phase of the current applied to the motor during one cycle are symmetrical, the integrated value of the current applied to the motor during one cycle is equal to '0'. In addition, when the positive phase and the negative phase of the current applied to the motor are symmetrical, the AC component of the current is maintained while the DC (offset) component of the current generating a copper loss is eliminated. Namely, in the present invention, a control signal for differently controlling the firing angle of the triac during the positive phase and the firing angle of the triac during the negative phase of the voltage applied to the motor is applied to the triac to supply the motor with waveforms of the symmetrical current component.

The operation of the apparatus for controlling the operation of the reciprocating motor compressor in accordance with the present invention will be described in detail with reference to FIGS. 4 and 5.

FIG. 5 is a flow chart of a method for controlling the operation of the reciprocating motor compressor in accordance with the present invention.

First, the current detector 20 detects the current being applied to the motor (M) of the compressor and outputs the detected current value to the stroke calculator 30 and to the current integrator 60 (step S11). At this time, the voltage detector 10 detects the voltage being applied to the motor (M) of the compressor and outputs the detected voltage value to the stroke calculator 30.

The stroke calculator 30 calculates a stroke of the compressor based on the current value outputted from the current detector 20 and the voltage value outputted from the voltage detector 10.

Thereafter, the current integrator 60 integrates the current value outputted from the current detector 20 and outputs the integrated current value to the controller 50. Namely, the current integrator 60 integrates the current applied to the motor during each one cycle and outputs the integrated current value to the controller 50 (step S12).

Meanwhile, the comparator 40 compares the stroke estimation value and the stroke reference value and outputs a difference value according to the compared result.

The controller 50 controls the turn-on period of the triac connected in series with the motor according to the difference value. At this time, the controller 50 controls the firing angle of the triac during the positive phase of the voltage according to the difference value outputted from the comparator 40.

If the integrated current value is smaller than '0', the controller 50 increases the firing angle of the triac during the negative phase of the voltage (steps S13 and S14), while if the integrated current value is greater than '0', the controller 50 decreases the firing angle of the triac during the negative phase of the voltage (step S15).

FIG. 6 is a waveform diagram showing waveforms of the voltage and current applied to a motor of the compressor by the apparatus for controlling the operation of the reciprocating motor compressor in accordance with the present invention.

As shown in FIG. 6, the firing angle ($\alpha$1) of the triac during positive phase of the voltage applied to the motor and the firing angle ($\alpha$3) of the negative phase are differently controlled to eliminate the DC component of the current applied to the motor of the compressor, whereby the positive phase and the negative phase of the current applied to the motor become symmetrical and the current as such is applied to the motor, reducing the loss in the motor.

Thus, in the present invention, in brief, the firing angle of the triac during positive phase and the firing angle of the triac during the negative phase of the voltage applied to the motor are controlled to be different and the current applied to the motor during each one cycle is integrated, and then, if the integrated current value is greater than '0', the firing angle ($\alpha$3) of the triac during the negative phase of the voltage is reduced while if the integrated current value is smaller than '0', the firing angle ($\alpha$3) of the triac during the negative phase of the voltage is increased to make the positive phase and the negative phase of the current applied to the motor symmetrical. With the negative phase and the positive phase of the current symmetrical, no DC offset component is present in the current applied to the motor. Herein, preferably, the firing angle ($\alpha$1) during the positive voltage phase is the same as in the prior art.

As so far described, the apparatus and method for controlling an operation of a reciprocating motor compressor in accordance with the present invention has the advantage that since the firing angle during the positive phase and the firing angle during the negative phase of the AC voltage applied to the motor of the compressor may be controlled different as appropriate, the positive phase and the negative phase of the current applied to the motor can be made symmetrical. Namely, by avoiding that any DC component current is applied to the motor by controlling the negative phase and the positive phase of the current applied to the motor to be symmetrical, the loss in the motor can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a reciprocating compressor comprising:

a current integrator for integrating an alternating current applied to a motor of the reciprocating compressor during a cycle of the current; and a controller for variably controlling a firing angle of a triac through which the current is applied to the motor during a positive phase portion and a negative phase portion of an alternating current (AC) voltage applied to the motor, based on an integrated value of the current, wherein the controller reduces the firing angle during the negative phase portion of the alternating current voltage when the integrated value of the current is greater than zero, and wherein the controller increases the firing angle during the negative phase portion of the alternating current voltage when the integrated value of the current value is less than zero.

2. The apparatus of claim 1, wherein the controller controls the firing angle differently during each of the positive phase portion and the negative phase portion such that a positive phase portion and a negative phase portion of the current applied to the motor are symmetrical.

3. The apparatus of claim 1, wherein the controller controls the firing angle during each of the positive phase portion and the negative phase portion differently to prevent a direct current (DC) component of the current from being applied to the motor.

4. An apparatus for controlling the operation of a reciprocating compressor comprising:

a current detector for detecting a current applied to a motor of the reciprocating compressor;

a voltage detector for detecting an alternating current (AC) voltage applied to the motor;

a stroke calculator for calculating a stroke estimation value of the reciprocating motor compressor based on a detected value of current and a detected value of voltage;

a current integrator for integrating a current detected by the current detector during a cycle of the current;

a comparator for comparing the stroke estimation value and a pre-set stroke reference value, and for outputting a difference value according to the comparison; and a controller for controlling a turn-on period of a switching device connected in series with the motor according to the difference value, and for generating a control signal for variably controlling a firing angle of the switching device during a positive phase portion and a negative phase portion of the alternating current voltage applied to the motor based on an integrated value of the current, and for outputting the generated control signal to the switching device, wherein the controller reduces the firing angle during the negative phase portion of the alternating current voltage when the integrated value of the current is greater than zero, and wherein the controller increases the firing angle during the negative phase portion of the alternating current voltage when the integrated value of the current is less than zero.

5. The apparatus of claim 4, wherein the switching device is a triac.

6. The apparatus of claim 5, wherein the triac is turned on by the control signal.

7. The apparatus of claim 6, wherein the controller controls the firing angle differently during each of the positive phase portion and the negative phase portion such that a positive phase portion and a negative phase portion of the current applied to the motor are symmetrical.

8. The apparatus of claim 6, wherein the controller controls the firing angle differently during each of the positive phase portion and the negative phase portion to prevent a direct current (DC) component of the current from being applied to the motor.

9. The apparatus of claim 8, wherein the firing angle during the positive phase portion is fixed when the firing angle during the negative phase portion of the voltage is increased or decreased.

10. A method for controlling an operation of a reciprocating compressor comprising:

integrating an alternating current applied to a motor of the reciprocating compressor during a cycle of the current;

and variably controlling a turn-on time of a switching device that switches the application of the current to the motor during a positive phase portion and during a negative phase portion of an alternating current (AC) voltage applied to the motor based on an integrated current value, wherein variably controlling the turn-on time comprises reducing a firing angle of the switching device during the negative phase portion of the alternating current voltage when the integrated current value is greater than zero, and increasing the firing angle of the switching device during the negative phase portion of the alternating current voltage when the integrated current value is less than zero.

11. The method of claim 10, wherein the firing angle during the positive phase portion is fixed when the firing angle during the negative phase portion of the voltage is increased or decreased.

* * * * *